US007074130B2

(12) United States Patent
Haisley

(10) Patent No.: US 7,074,130 B2
(45) Date of Patent: Jul. 11, 2006

(54) BOWLING BALL HOLE INSERT

(76) Inventor: Scott Haisley, 2001 Batavia Ave., Muncie, IN (US) 47302

( * ) Notice: Subject to any disclaimer, the term of this patent is extended or adjusted under 35 U.S.C. 154(b) by 0 days.

(21) Appl. No.: 10/648,057

(22) Filed: Aug. 26, 2003

(65) Prior Publication Data

US 2004/0043823 A1 Mar. 4, 2004

Related U.S. Application Data

(60) Provisional application No. 60/406,387, filed on Aug. 27, 2002.

(51) Int. Cl.
*A63B 37/00* (2006.01)

(52) U.S. Cl. ..... 473/129; 473/130

(58) Field of Classification Search ..... 473/127–130
See application file for complete search history.

(56) References Cited

U.S. PATENT DOCUMENTS 2,435,327 A * 2/1948 Seurynck ..... 473/130
2,436,976 A * 3/1948 Seurynck ..... 473/130
3,012,783 A * 12/1961 Bunk ..... 473/129
4,247,102 A * 1/1981 Seyler ..... 473/129
4,561,654 A * 12/1985 Haza ..... 437/129
4,892,308 A 1/1990 Gaunt
5,118,106 A 6/1992 Goldman
5,505,666 A * 4/1996 Arsenault ..... 473/129
5,520,582 A 5/1996 Lathrop
5,536,212 A * 7/1996 Tryon ..... 473/129
5,584,767 A 12/1996 Picchietti et al.
5,795,236 A * 8/1998 Alberts et al. ..... 473/129
5,800,276 A 9/1998 Hill
6,126,553 A 10/2000 Lakusiewicz
6,142,881 A 11/2000 Lakusiewicz
6,238,297 B1 5/2001 Tilton
6,280,343 B1 8/2001 Scheid et al.

* cited by examiner

*Primary Examiner*—William M. Pierce

(57) ABSTRACT

The present invention relates to inserts for holes in bowling balls, and more specifically, provides an insert which is easily installed and easily interchangeable. One preferred embodiment of the present invention utilizes a two-piece insert where the base portion is attached inside the bowling ball hole and the sleeve portion is removably attached to the base portion. Other preferred embodiments utilize a locking mechanism to prevent rotation between the base portion and the sleeve portion. Further embodiments utilize differently sized and shaped interior cavities of the sleeve portion to accommodate various sizes and shapes of fingers and thumbs, while still other embodiments utilize an insert with a multiple outer diameters and a method for controlling the diameter of the hole to provide an insert that may be easily inserted or removed by hand.

12 Claims, 4 Drawing Sheets

BOWLING BALL HOLE INSERT

This application incorporates by reference and claims the benefit of U.S. Provisional Application No. 60/406,387, filed Aug. 27, 2002.

FIELD OF THE INVENTION

The present invention relates to inserts for holes in bowling balls. In particular, the invention relates to a device insertable into a finger or thumb hole in a bowling ball to vary the effective size, shape, alignment, texture or color of the hole.

BACKGROUND OF THE INVENTION

A traditional bowling ball contains holes into which the player generally fits a thumb and two fingers in order to propel the ball down an alley toward a set of pins. Typically, a drill and drill bit are used to bore holes of fixed diameter in the bowling balls. Difficulties can arise when a player's digits swell or contract due to various conditions, making fixed size holes more difficult or inappropriate to use under these varying conditions. Examples of such conditions are time of day, temperature, diet, or weight. Other difficulties can arise while drilling the holes that may render the bowling ball unusable or awkward to use, such as misalignment of the drill bit or drilling with a bit that is too large for the player's digit.

Previous inventions have used non-removable hole inserts. However, typically these non-removable inventions do not allow a player to change inserts without expending substantial time and effort. Other inventions have used removable inserts that can become loose during play and extend past the outer surface of the bowling ball. Still other inventions have used removable inserts which may be affixed to the bowling ball by means of a screw or other device that penetrates the bowling ball beyond the limits of the drilled hole. However, these penetrating devices may diminish the integrity of the attachment location over time such that the inserts can no longer be easily used and may require additional fastening hardware that is difficult to use. Still other inventions have used removable inserts which are held in the hole using a type of tape or glue. However, devices taped or removably glued in the hole are generally difficult to remove, may damage the insert as it is removed, and may begin to slip from their proper position in the hole as the weaker, non-permanent glue deteriorates over time. Yet other inventions have used removable spacers which are affixed to the player's digits, such as tape. However, spacers affixed to the player's digits wear out rapidly and pose a danger of remaining lodged in the hole.

SUMMARY OF THE INVENTION

Preferred embodiments of the present invention provide an insert, or interchangeable inserts, for placement in finger and/or thumb holes in bowling balls.

In one preferred embodiment, the base portion of an insert is attached to the inside of a bowling ball finger or thumb hole. A sleeve portion is then inserted into the same hole and removably attached to the base portion. The sleeve portion contains an interior cavity into which a finger or thumb may be inserted. Interchangeable sleeves may have differently sized or shaped cavities allowing a bowler to quickly change the size of the bowling ball finger or thumb hole to accommodate varying requirements, such as the bowlers' fingers expanding or contracting due to time of day, temperature, or humidity changes for example.

In an alternate preferred embodiment, a locking mechanism is utilized to prevent rotation between the base portion and the sleeve portion. In still other preferred embodiments, the fit between the sleeve outer surface and the hole is controlled to allow ease of installation while ensuring the insert fits snugly in the hole.

Alternate preferred embodiments and features provide for bowling ball inserts that can be used as a display stand or for accenting the appearance of the bowling ball.

It is one preferred object of the present invention to provide an improved insert for bowling balls. It is another preferred object of the present invention to provide an easily installed and easily interchangeable insert for a bowling ball hole.

Other objects and advantages of preferred embodiments of the present invention shall be apparent from the accompanying drawings and description.

DESCRIPTION OF THE PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

The present invention relates to an insert that fits into the digit (finger or thumb) holes in bowling balls and, once the base is installed, may be easily installed or removed. One preferred advantage of such a system is that it allows a player to easily interchange inserts of different sizes to accommodate swelling or shrinking of the player's fingers and thumb relative to the hole. Additional preferred advantages are that the insert may be removed or inserted with minimal additional tools and no additional fastening hardware, use of the insert does not require the penetration of additional hardware into the bowling ball to hold the insert in place, different density material may be used to appropriately match the density of the bowling ball, different textured material may be used to affect the player's grip, different colors may be used to change the appearance of the bowling ball, and the insert may be used to compensate for incorrectly drilled holes such that a player may continue to use the ball with the incorrectly drilled holes.

Figure 1:
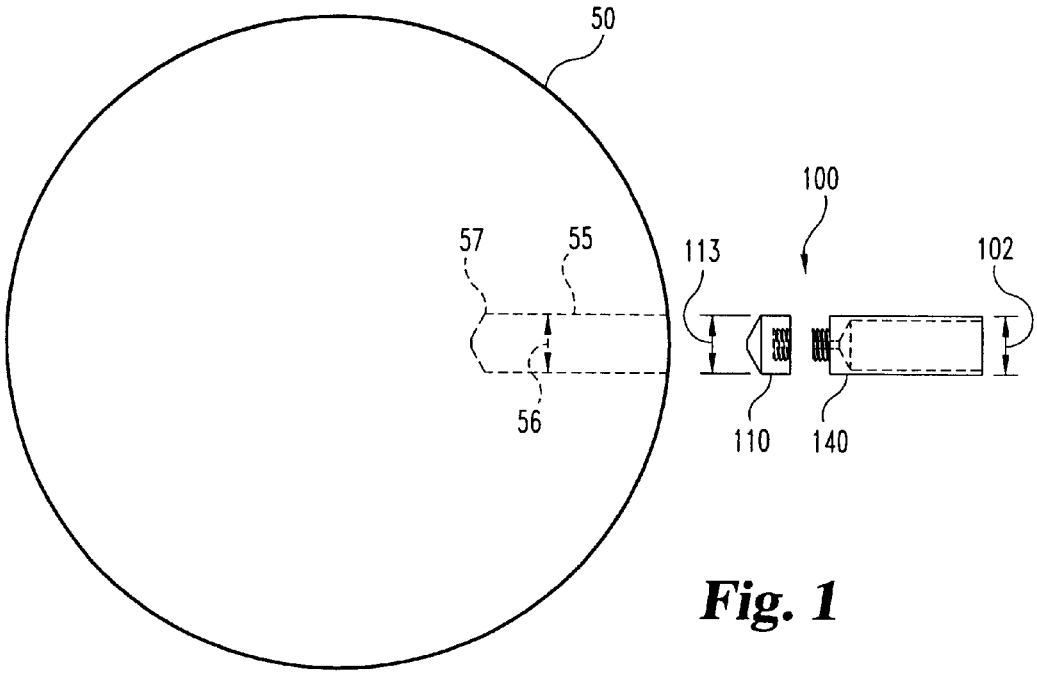
FIG. 1 is a transparent, exploded side view depiction of a bowling ball with a hole and a preferred embodiment of the invention positioned outside the hole.
Figure 2:
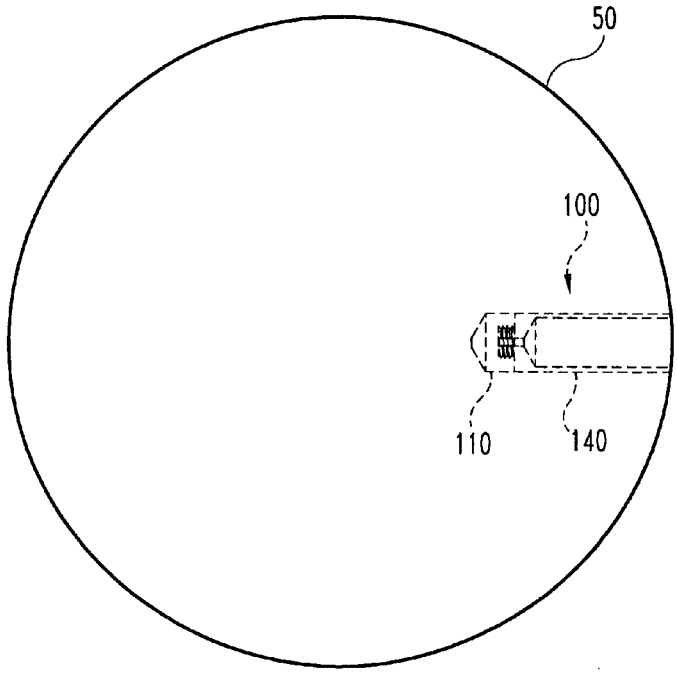
FIG. 2 is a transparent side view depiction of a bowling ball with the embodiment depicted in FIG. 1 inserted.

FIG. 1 depicts an exploded view of bowling ball 50 with a preferred embodiment of insert 100 positioned outside hole 55, and FIG. 2 depicts the preferred embodiment of FIG. 1 inserted into hole 55. Bowling ball 50 is a generic bowling ball in which any of the embodiments of the present invention may be mounted. In broadest terms, the embodiment includes a base portion 110 securable within hole 55 and a sleeve portion 140 insertable in hole 55 and securable to base portion 110. A separate apparatus, such as a drill press, is used to drill hole 55 in ball 50 into which insert 100 is to be placed. Hole 55 may be drilled to various different sizes with diameter 56 preferably sufficient to enclose natural or mechanical digits ranging from approximately one-quarter of an inch to approximately one and three-quarters inches in diameter. Proper sizing of hole 55 for insert 100 may be simplified by using a standardized drill bit diameter which corresponds to a standardized insert outer diameter 102. Insert outer diameter 102 will typically be the larger of base portion outer diameter 113 and sleeve portion outer diameter 143. If using a standardized insert diameter, all holes drilled into a bowling ball may be drilled at the same size thereby reducing the complexity of the drilling process.

Base portion 110 is affixed to bottom portion 57 of hole 55 in bowling ball 50 using various methods which are preferably non-removable, such as by chemical or mechanical means. Examples include the use of glues, epoxies, threaded screw-type devices and friction fittings, such as pronged devices or by tightly fitting base portion 110 in hole 55. When affixing base portion 110 inside hole 55, various means of positioning may be used, including, for example, use of sleeve portion 140, use of a separate installation tool (not pictured) or a human digit.

Once affixed to the ball, base portion 110 receives sleeve portion 140 such that sleeve portion 140 will be securely held inside hole 55 by removable attachment to base portion 110. Outer diameter 143 of sleeve portion 140 may be manufactured in various sizes, but should typically be slightly smaller than diameter 56 of hole 55 into which it is being placed such that sleeve portion 140 fits snugly, but may be easily attached to, or removed from, base portion 110 without becoming stuck in hole 55. This simplicity of installation and removal allows for easy interchangeability of different sleeve portions with the same bowling ball, or with different bowling balls.

In a preferred embodiment, sleeve portion 140 does not protrude past the surface of bowling ball 50, thereby allowing bowling ball 50 to roll properly; however, other instances may occur where some protrusion is desired, such as when using the invention as a pedestal to display bowling ball 50. To ensure sleeve portion 140 does not protrude, various methods may be used. Some examples include shortening the length of sleeve portion 140 by cutting or grinding after determining it is too long for a hole, using variously sized sleeve portions to match various hole depths, and varying the hole depth depending on a set sleeve length.

Figure 3A:
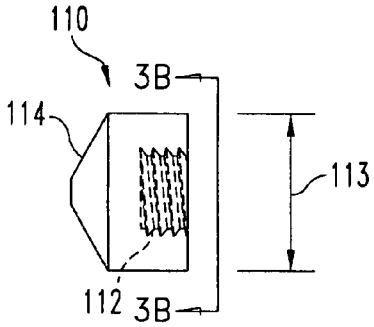
FIG. 3A is a transparent side view of the base portion of the embodiment depicted in FIG. 1.

A side view of a preferred embodiment of base portion 110 is depicted in FIG. 3A. Base portion 110 may be constructed of various materials with sufficient characteristics to withstand being affixed to the bowling ball and being able to securely hold sleeve portion 140 when it is attached. Additional desirable material characteristics of base 110 allow base 110 to be machined and/or molded. Examples of appropriate material for base portion 100 are various organic and inorganic compounds, such as molded or extruded urethane or plastic, fiberglass, various metals, and wood. Preferably, materials used in manufacturing base portion 110 conform with the standards used in bowling balls for tournament play, such as the standards of the American Bowling Congress, although this is not necessary as other advantages of using different materials may be realized for non-tournament play.

Figure 3B:
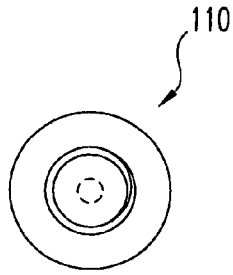
FIG. 3B is a transparent end view of the base portion of the embodiment depicted in FIG. 1 as viewed along line 3B—3B of FIG. 3A.

Base portion 110 is preferably circular in cross section, as depicted in FIG. 3B, with outer diameter 113 substantially equal to diameter 56 of hole 55. In a preferred embodiment, base portion 110 will have an end portion 114 whose shape will correspond to the shape in bottom portion 57 of hole 55, which typically matches a drill bit taper, in order to facilitate a more secure attachment to bowling ball 50. This embodiment facilitates compliance with American Bowling Congress standards that require bowling ball 50 to be free from voids in its interior. The shape of end portion 114 can be standardized to match any preferred shape.

Base portion 110 contains base coupling portion 112 which is designed to receive sleeve coupling portion 142 on sleeve portion 140. Although base coupling portion 112 is depicted as a female-threaded section with sleeve coupling portion 142 depicted as a male-threaded section, it is understood that base coupling portion 112 may be the male portion with sleeve coupling portion 142 being the female portion. Other connection means may also be used, such as the use of pins or detents in one portion and receptacles for the pins or detents in the other portion.

In one preferred embodiment, all base coupling portions 112 and all sleeve coupling portions 142 use a standardized thread design to facilitate the interchangeability of different sleeve portions 140 within the same hole 55, or between different holes 55 and/or bowling balls 50. In another preferred embodiment, various thread designs for mating base coupling portion 112 and sleeve coupling portion 142 are used with markings, such as symbols or colors, that are placed on similarly threaded base and sleeve coupling portions to allow a player to match similarly threaded sections. For example, all base and sleeve coupling portions with thread design A are marked with an "A," and all base and sleeve coupling portions with thread design B are marked with a "B."

Figure 4A:
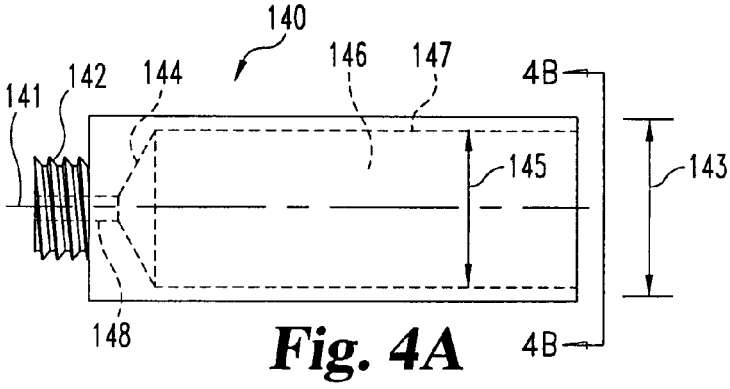
FIG. 4A is a transparent side view of the sleeve portion of the embodiment depicted in FIG. 1.

A side view of an embodiment of sleeve portion 140 is depicted in FIG. 4A. Sleeve portion 140 is preferably constructed of material with sufficient characteristics to remain attached to base portion 110 when inserted. Additional desirable material characteristics of sleeve 140 allow sleeve 140 to be machined and/or molded. Examples of appropriate materials for sleeve 140 are various organic and inorganic compounds, such as molded or extruded urethane or plastic, fiberglass, various metals, and wood.

A further advantageous characteristic of sleeve portion 140 is that it be constructed of material that is resistant to bonding with typical glues, such as epoxy, which might be used to secure base portion 110. This minimizes hazards associated with glue accidentally being placed in contact with sleeve portion 140 while sleeve portion 140 is in hole 55. An example of a desirable material for sleeve portion 140 is Delrin®. Preferably, materials used in manufacturing sleeve portion 140 conform to standards used in bowling balls for tournament play, although this is not necessary.

Figure 4B:
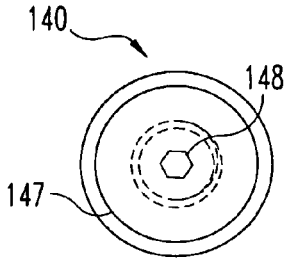
FIG. 4B is a transparent end view of the sleeve portion of the embodiment depicted in FIG. 1 as viewed along line 4B—4B of FIG. 4A.

Sleeve portion 140 contains a sleeve coupling portion 142 discussed above. Additionally, attachment of sleeve portion 140 to base portion 110 requires a method whereby it may be inserted and removed from base portion 110 when base portion 110 is properly positioned in hole 55. One such method is the use of a noncircular hole 148 in the bottom center portion of sleeve portion 140, depicted as a hexagonal hole in FIG. 4B. Using this feature, a hexagonal-tipped tool may be inserted into noncircular hole 148 and used to apply torque to sleeve portion 140 in order to either rotate sleeve coupling portion 142 into or out of base coupling portion 112. Thus, sleeve portion 140 may be either secured or released from base portion 110 when base portion 110 is properly positioned in hole 55, such that sleeve portion 140 may be easily removed from hole 55. An advantage to using a hexagonal hole is that hexagonal wrenches are commonly available. Other methods may be used to insert and remove sleeve portion 140 from base portion 110, for example, multiple off-center holes in the bottom of sleeve portion 140 that receive a multi-pronged torsion tool, a friction tool that expands to make contact with the walls of cavity 146 or rotating sleeve 140 by hand.

Cavity 146 is the portion where the player's finger or thumb is inserted during play and is defined by inside wall 147 and bottom surface 144 of sleeve portion 140. The thickness of inside wall 147 is defined as one half the difference between sleeve outer diameter 143 and sleeve inside wall diameter 145. Cavity 146 may be prefabricated to a desired size during the creation of sleeve portion 140 or enlarged later as desired. Alternately, sleeve portion 140 may be designed to have no cavity, or a minimal cavity, thereby requiring sleeve portion 140 to be custom drilled for the appropriate size after manufacture. Drilling of sleeve portion 140 may be performed parallel or nonparallel to, and either centered on or off-centered with, centerline 141 of sleeve portion 140. Nonparallel or off-center drilling may be preferred when using the invention to correct for an improperly aligned hole 55 in bowling ball 50. The bottom portion of cavity 146 may be beveled similar to the beveled portion left by a typical drill bit, as depicted in FIG. 4A, or may be of any desirable or functional shape.

Base portion 110 and sleeve portion 140 may optionally be constructed using colored materials. Specifically, it may be desirable to color sleeve portion 140 such that sleeve portion 140 will provide color accenting to the bowling ball. Various color dyes may be used to change the color of sleeve portion 140 including dyes that will make sleeve portion 140 glow in the dark.

Figure 5A:
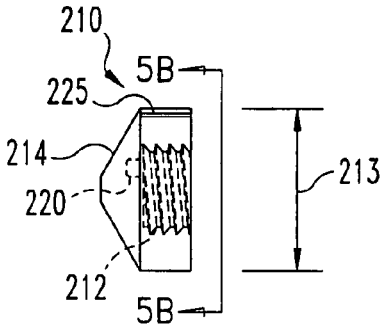
FIG. 5A is a transparent side view of the base portion of another embodiment of the present invention.
Figure 5B:
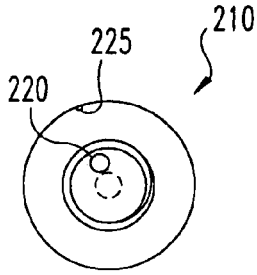
FIG. 5B is a transparent view of the base portion of the embodiment depicted in FIG. 5A as viewed along line 5B—5B of FIG. 5A.

An additional embodiment of the current invention is depicted in FIGS. 5A–6B, and is similar to the embodiment depicted in FIGS. 1–4B except as otherwise noted. Base portion 210 is depicted in FIGS. 5A and 5B. Base 210 includes base coupling portion 212, base end portion 214, alignment groove 225 and base locking portion 220. Base 210 also has an outer diameter 213.

Figure 6A:
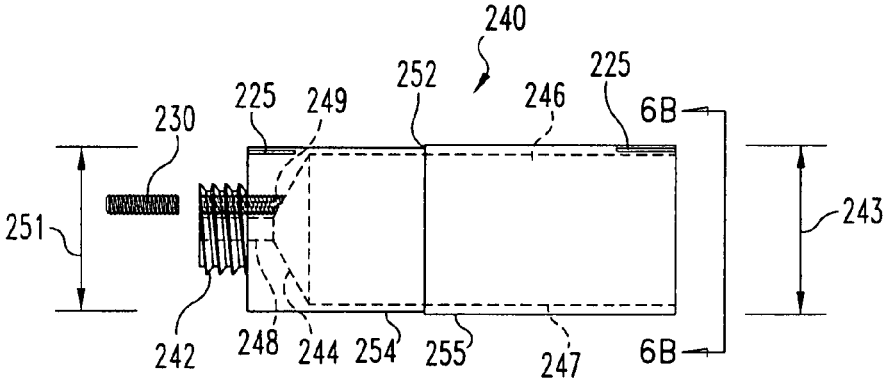
FIG. 6A is a transparent side view of the complimentary sleeve portion to the embodiment depicted in FIG. 5A.
Figure 6B:
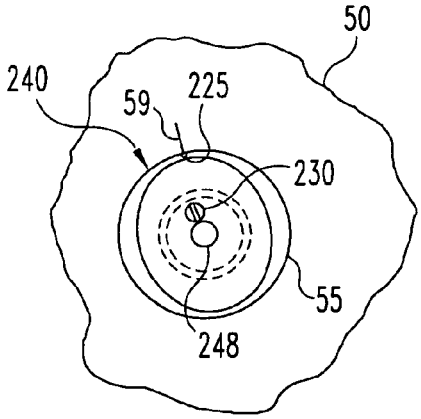
FIG. 6B is a transparent end view of the sleeve portion of the embodiment depicted in FIG. 6A as installed in a bowling ball and viewed along line 6B—6B of FIG. 6A.
Figure 7A:
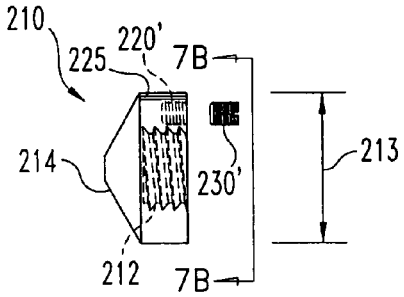
FIG. 7A is a transparent side view of the base portion of a further embodiment of the present invention.
Figure 7B:
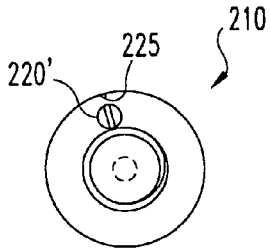
FIG. 7B is a transparent view of the base portion of the embodiment depicted in FIG. 7A as viewed along line 7B—7B of FIG. 7A.
Figure 8A:
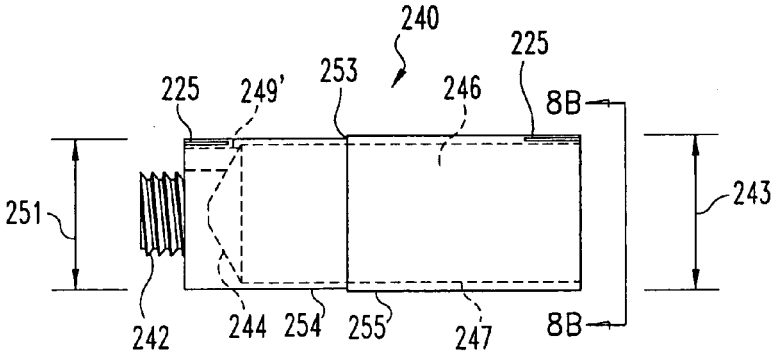
FIG. 8A is a transparent side view of the complimentary sleeve portion to the embodiment depicted in FIG. 7A.
Figure 8B:
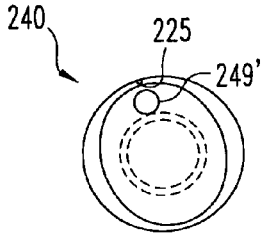
FIG. 8B is a transparent end view of the sleeve portion of the embodiment depicted in FIG. 8A as viewed along line 8B—8B of FIG. 8A.

Sleeve portion 240 is depicted in FIGS. 6A and 6B. Sleeve 240 includes sleeve coupling portion 242, sleeve lower portion 254, sleeve upper portion 255, circular hole 248, two alignment grooves 225, cavity 246, and sleeve locking portion 249. Cavity 246 is the area enclosed by cavity inside wall 247 and cavity bottom surface 244. Sleeve lower portion 254 has outer diameter 251 and sleeve upper portion 255 has outer diameter 243. In a preferred embodiment, diameters 251 and 255 are not equal and there is an outer diameter step 252 between portions 254 and 255.

When installed and in use, base 210 is mounted inside hole 55. Sleeve coupling portion 242 is then aligned with base coupling portion 212 and, when threaded, rotated in the proper direction to engage sleeve coupling portion 242 with base coupling portion 212. Prior to the point when sleeve coupling portion 242 is fully engaged with base coupling portion 212, sleeve locking portion 249 aligns with base locking portion 220. Other embodiments have sleeve locking portion 249 aligned with base locking portion 220 when sleeve coupling portion 242 and base coupling portion 212 are fully engaged.

In a preferred embodiment, sleeve 240 includes one or more alignment indicators to indicate the alignment of sleeve locking portion 249 and base locking portion 220. Other embodiments include one or more alignment indicators on base 210. Example alignment indicators are depicted as alignment grooves 225. Base 210 includes one alignment groove 225 and sleeve 240 includes two alignment grooves 225. When sleeve locking portion 249 and base locking portion 220 align, the alignment groove 225 on base 210 aligns with the two alignment grooves 225 on sleeve 240.

A mark, such as mark 59 (depicted in FIG. 6B), may be placed on bowling ball 50 to which the groove 225 on sleeve 240 nearest the surface of ball 50 may be aligned in order to aid the user in determining alignment between sleeve locking portion 249 and base locking portion 220 when sleeve 240 is inserted into hole 55. Various types of marks on the ball surface or hole edge may be utilized, such as ink lines, scratches or file marks, by way of non-limiting examples.

In one preferred embodiment, a locking member is used to prevent the relative rotation of sleeve 240 and base 210. An example locking member is depicted as threaded locking member 230. In another preferred embodiment there are corresponding threads in sleeve locking portion 249 and no corresponding threads (a smooth bore) in base locking portion 220. Additionally, locking member 230, base locking portion 220 and sleeve locking portion 249 may be of various designs with or without threading provided that locking member 230 securely extends into both sleeve locking portion 249 and base locking portion 220 during use.

In one preferred embodiment, locking member 230 is inserted into sleeve locking portion 249 and rotated until it extends into base locking portion 220, thereby preventing further rotation between sleeve 240 and base 210. In other preferred embodiments, locking member 230 is inserted into base locking portion 220 and rotated until it extends into sleeve locking portion 249.

Locking member 230 may be comprised of various materials supplying sufficient strength to prevent relative rotational movement between base 210 and sleeve 240, such as, nylon, wood, various metals and various plastics by way of non-limiting example. For regulation play, the material for locking member 230 should comply with the appropriate bowling regulation.

In one optional feature, cavity 246 is elliptical (as depicted in FIG. 6B), which may provide certain advantages to certain bowlers such as a different "feel" or an increased ability to control the bowling ball. In other embodiments, cavity 246 may be of various other shapes, including circles or polygons, or have various textures on side wall 247 or surface 244, such as a burled or rifled texture, depending on an individual bowler's preferences. In an alternate embodiment, cavity 246 will initially be relatively small and only large enough to expose sleeve locking portion 249, thereby allowing users to drill cavity 246 to their individual preferences. In yet another embodiment, cavity 246 is initially the same size as, and aligned with, sleeve locking portion 249, which also allows the user to drill any desired hole shape or alignment into sleeve 240 while providing a hole through which locking member 230 may be rotated by a screwdriver or other device.

In a further optional feature, sleeve 240 utilizes two different outer diameters to allow easy and secure installment of sleeve 240 in hole 55. Typically, when hole 55 is drilled into bowling ball 50, the relatively soft interior of bowling ball 50 results in the walls of hole 55 expanding slightly inward after the drill bit is removed, which decreases hole diameter 56. This decreasing of hole diameter 56 may not be uniform throughout the hole resulting in variations in hole diameter 56. The amount of inward expansion varies between bowling balls depending on the material used in the bowling ball interior.

To avoid unpredictability in the diameter 56 and the shape of the walls of hole 55, the walls of hole 55 may be smoothed using a reamer after initial drilling. Utilizing a reamer ensures a more predictable fit between hole 55 and sleeve 240 and a fit that is sufficiently snug to prevent rattling of sleeve 240 in hole 55 while allowing rotation of sleeve 240 during coupling with base 210.

Reaming the full depth of hole 55 may not be desirable in certain circumstances. To provide the ability to ream only a portion of hole 55, sleeve lower portion 254, the portion near sleeve coupling portion 242, is manufactured at a smaller outer diameter 251, while sleeve upper portion 255, the portion near the surface of ball 50, is manufactured at a larger outer diameter 243. Preferably, sleeve upper portion 255 fits snugly against the walls of hole 55 and helps prevent sleeve 240 from becoming loose near the surface of ball 50. Sleeve lower portion 254 fits less snugly, thereby decreasing the total friction exerted on sleeve 240 by the walls of hole 55. By varying the portion of hole 55 reamed after initial drilling and the percentages that sleeve lower portion 254 and sleeve upper portion 255 comprise the outer surface of sleeve 240 (varying location of outer diameter step 252), the torque required to rotate sleeve 240 can be controlled while simultaneously preventing sleeve 240 from becoming loose near the surface of ball 50.

By way of non-limiting example, hole 55 is originally drilled to a 1.25" diameter and then reamed to the same 1.25" diameter after the drill bit is removed. Additional example dimensions are a 1.240" diameter for outer diameter 251 and a 1.245" diameter for outer diameter 243.

Preferably, sleeve 240 may be coupled to base 210 by rotating sleeve 240 using fingers or thumbs. Fully tightening sleeve coupling portion 242 to base coupling portion 212 is not required due to the alignment of sleeve locking portion 249 and base locking portion 220 prior to full engagement between coupling portions 242 and 212, thus a tool is not required to apply torque to sleeve 240, allowing hole 248 to be circular, which has certain manufacturing advantages over a non-circular hole. Allowing sleeve 240 to be rotated by hand also minimizes the number of tools required when installing or changing sleeve 240.

A further embodiment of the present invention is depicted in FIGS. 7A–8B, which is similar to the embodiment depicted in FIGS. 5A–6B except as otherwise indicated. Base locking portion 220' is located outside base coupling portion 212. Locking member 230' is inserted into base locking portion 220'. After sleeve coupling portion 242 is coupled to base coupling portion 212 and grooves 225 are aligned, thereby aligning base locking portion 220' and sleeve locking portion 249', locking member 230' is rotated until it protrudes into both sleeve locking portion 249' and base locking portion 220'. Furthermore, there is no hole similar to hole 248 in FIG. 6A and extending through the center of sleeve coupling portion 242. Since sleeve 240 may be coupled to base 210 using fingers, there is no need for a tool to tighten sleeve 240 onto base 210 and no requirement for a hole similar to hole 248.

In other preferred embodiments, the present invention will conform with official bowling standards, such as those of the American Bowling Congress and/or the Women's International Bowling Congress, when installed.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for a bowling ball with a hole, comprising:

a base mountable to the hole, wherein said base includes an integral coupling portion and an outer diameter, wherein said coupling portion is threaded;

a one-piece sleeve with an integral coupling portion and a first outer diameter, wherein said sleeve coupling portion is threaded and one of said sleeve coupling portion and said base coupling portion has an outer diameter that rotatably engages the other of said sleeve coupling portion and said base coupling portion, and wherein said sleeve first outer diameter is substantially equal to said base outer diameter; and, wherein said base includes a base locking portion, said sleeve includes a sleeve locking portion, and comprising a locking member which is engaged with said base locking portion and said sleeve locking portion to selectively prevent the base from rotating with respect to said sleeve.

2. The apparatus of claim 1, wherein said locking member is threaded.

3. The apparatus of claim 2, wherein one of said sleeve locking portion and said base locking portion are threaded to receive said locking member.

4. The apparatus of claim 1, wherein said locking member is plastic.

5. The apparatus of claim 1, wherein said locking member is disposed entirely within said base locking portion and said sleeve locking portion.

6. The apparatus of claim 4, wherein said sleeve includes an alignment indicator, wherein said alignment indicator indicates the alignment of said base coupling portion with said sleeve coupling portion.

7. An apparatus, comprising:

a bowling ball with a digit hole;

a base mounted within said hole, wherein said base has a diameter and includes an integral coupling portion; and a one-piece sleeve with an integral coupling portion, wherein said sleeve has a diameter substantially equal to said base diameter, and wherein one of said sleeve coupling portion and said base coupling portion has an outer diameter which is threadably engaged to an inner diameter of the other of said sleeve coupling portion and said base coupling portion;

wherein said base coupling portion is threaded, and said sleeve coupling portion is threaded and rotatably engages said base coupling portion; and, wherein said base includes a base locking portion, said sleeve includes a sleeve locking portion, and further comprising a locking member which is engaged with said base looking portion to prevent rotation with respect to said sleeve locking portion after said base and said sleeve are threadably engaged.

8. The apparatus of claim 7, wherein said base, said sleeve and said locking member are plastic.

9. An apparatus for a bowling ball with a hole, comprising:

a base mountable to the hole, wherein said base includes an integral threaded portion, a base locking portion and an outer diameter;

a sleeve with an integral threaded portion, a cavity, a first outer diameter, a second outer diameter, a centerline and a sleeve locking portion, wherein said sleeve locking portion is offset from said centerline, said sleeve threaded portion is rotatably engaged to said base threaded portion, said sleeve first outer diameter is substantially equal to said base outer diameter and said cavity is a cylindrical ellipse; and a locking member which is threaded and engaged with said base locking portion and further engaged with said sleeve locking portion, wherein said looking member prevents relative rotation between said base and said sleeve.

10. The apparatus of claim 9, wherein said base, said sleeve and said locking member are plastic.

11. An apparatus for a bowling ball with a hole, comprising:

a base mountable to the hole, wherein said base includes an integral coupling portion and an outer diameter, wherein said coupling portion is threaded;

a one-piece sleeve with an integral coupling portion and a first outer diameter, wherein said sleeve coupling portion is treaded and one of said sleeve coupling portion and said base coupling portion has an outer diameter that rotatably engages the other of said sleeve coupling portion and said base coupling portion, and wherein said sleeve first outer diameter is substantially equal to said base outer diameter; and, means for preventing rotation of said sleeve relative to said base after said sleeve coupling portion is rotatably engaged to said base coupling portion.

12. The apparatus of claim 11, wherein said means includes a set screw.

* * * * *

UNITED STATES PATENT AND TRADEMARK OFFICE

CERTIFICATE OF CORRECTION

PATENT NO. : 7,074,130 B2
APPLICATION NO. : 10/648057
DATED : July 11, 2006
INVENTOR(S) : Scott Haisley It is certified that error appears in the above-identified patent and that said Letters Patent is hereby corrected as shown below:

In Col. 10, at line 7, replace “looking” with --locking--.

In Col. 10, at line 16, replace “treaded” with --threaded--.

Signed and Sealed this

Fifth Day of September, 2006

JON W. DUDAS
*Director of the United States Patent and Trademark Office*